US011058917B1

(12) United States Patent
Hutt et al.

(10) Patent No.: US 11,058,917 B1
(45) Date of Patent: Jul. 13, 2021

(54) EXERCISE MACHINE FOR FORM TRAINING SYSTEM

(71) Applicants: Didi Hutt, Great Neck, NY (US); Charles Bibas, Great Neck, NY (US)

(72) Inventors: Didi Hutt, Great Neck, NY (US); Charles Bibas, Great Neck, NY (US)

(73) Assignee: Didi Hutt, Great Neck, NY (US)

( * ) Notice: Subject to any disclaimer, the term of this patent is extended or adjusted under 35 U.S.C. 154(b) by 0 days.

(21) Appl. No.: 16/776,819

(22) Filed: Jan. 30, 2020

(51) Int. Cl.

| | |
|---|---|
| ***A63B 24/00*** | (2006.01) |
| ***A63B 22/02*** | (2006.01) |
| ***A63B 22/06*** | (2006.01) |
| ***A63B 21/00*** | (2006.01) |
| ***A63B 71/06*** | (2006.01) |

(52) U.S. Cl.
CPC ..... *A63B 24/0075* (2013.01); *A63B 21/4035* (2015.10); *A63B 22/02* (2013.01); *A63B 22/06* (2013.01); *A63B 24/0062* (2013.01); *A63B 24/0087* (2013.01); *A63B 71/0622* (2013.01); *A63B 2071/065* (2013.01); *A63B 2071/0658* (2013.01); *A63B 2220/52* (2013.01); *A63B 2220/833* (2013.01)

(58) Field of Classification Search
CPC ..... A63B 24/0075; A63B 24/0062; A63B 71/0622; A63B 21/4035; A63B 24/0087; A63B 2071/0658; A63B 2071/065; A63B 2220/52; A63B 2220/833; A63B 22/0076–0089; A63B 22/02–0292; A63B 22/06–0694; A63B 21/4037; A63B 6/00; A63B 6/02
See application file for complete search history.

(56) References Cited

U.S. PATENT DOCUMENTS

2014/0342118 A1* 11/2014 Connaughton ..... B32B 3/266 428/139
2015/0364059 A1* 12/2015 Marks ..... G06F 3/017 482/9
2017/0209742 A1* 7/2017 Merkel ..... G06F 19/00

OTHER PUBLICATIONS

Body Positive Yoga Document (derived from: Body Positive Yoga, "Downward facing dog: A guide for plus size yogis & beginners" [online], May 25, 2012 [retrieved on Dec. 11, 2020], Retrieved from: https://bodypositiveyoga.com/downward-facing-dog-a-guide-for-beginners-and-plus-size-yogis/ (Year: 2012).*

* cited by examiner

*Primary Examiner* — Loan B Jimenez
*Assistant Examiner* — Catrina A Letterman

(57) ABSTRACT

To provide stationary bicycle users and training exercise equipment, such as rowing machines or stationary bicycles with the ability to track their exercise form, and offer corrective action for proper form and better machine usage, the present system and methods describe an activity tracking system. The system includes sensors configured to monitor changes in force distribution of the user on the exercise equipment. The sensors can be configured and positioned to match the majority of stationary bikes and exercise equipment. Responsive to detecting activity data, a computer controller connected to the sensors can associate the data with a baseline and produce suggestive corrective actions for the user to correct their balance and enhance their workout.

18 Claims, 9 Drawing Sheets

EXERCISE MACHINE FOR FORM TRAINING SYSTEM

FIELD OF INVENTION

The present invention relates to a monitoring system for an exercise equipment, and more particularly to a stationary bike monitoring system, which monitors the biker's form, such as tilting, leaning, and weight distribution, and controls a display content appearing on a screen representative of the form.

BACKGROUND OF INVENTION

The present invention generally relates to the field of exercise and training equipment (hereinafter referred to as "equipment"), and more specifically, to stationary training equipment such as rowing machines, treadmills, and bicycles.

Watterson in U.S. Pat. No. 10,493,349, issued Dec. 3, 2019, discloses a display device mounted on stationary training equipment, such as a treadmill or a bike, to display present information associated with the user's workout, with local news, with other types of information, or combinations thereof. See FIG. 1 (Prior Art).

Another type of treadmill disclosed in U.S. Patent Publication No. 2009/0209393 issued to Bradley A. Crater. In this reference, a simulated display of a treadmill's console is described. According to one embodiment, the console displays a visual representation of the course over which the user is running. The course may be displayed with video footage that corresponds to the user's location on the course, by using still pictures, or by using computer-generated simulations of the course. See FIG. 2 (Prior Art).

Irving discloses, in U.S. Pat. No. 10,398,934 Sep. 3, 2019, a system in which a stationary bicycle simulates a ride. Although Irving addresses a simulated ride, it does not address the proper weight distribution and corrective action.

SUMMARY OF THE INVENTION

The present invention is an exercise device that includes an apparatus for enabling the user to interact with a display unit where the user reads the imbalance points related to the weight distribution and takes corrective action to correct. Such corrective action is followed by an update of a new weight distribution status on display continuously. Weight, weight distribution or pressure will be used to describe measurements of electrical signals reading from sensors reflecting weight and/or pressure.

In one aspect of the invention, the apparatus is comprised of a kit, including a display unit, a computer processor, and set of sensors. Alternatively, a sensor mat or a solid flat board where the sensor mat is mounted. Software stored in non-transitory memory and running on the computer processor is responsible for:

Sensor scanning;

Analyzing the streaming data from the sensors;

Algorithm to update deviation from baseline; and

Display update

These and other advantages of the present invention become apparent to those skilled in the art from the following detailed description of the invention and the accompanying drawings.

BACKGROUND

There are many indoor spinning stationary bicycle exercise classes like Soul Cycle™, Peloton™, and Flywheel™ as well as those in independent gyms. These classes are prevalent. However, the instructors are continually warning the riders to maintain proper form by not leaning on the handlebars putting all their weight onto their hands. Since the classes are generally quite large, with anywhere from 40 to 80 riders, the instructors cannot correctly monitor each rider's form throughout the whole 45-60-minute class. Proper form requires pulling the lower part of the body back as far as possible. In so doing, the rider engages core strength using stomach muscles throughout the exercise class. Awareness of proper weight distribution throughout the class results in a more significant optimal workout benefit by ensuring the rider does not lean on the handlebars with their hands and arms, which put a strain on the back.

Due to improper form in riding the stationary spinning bicycle, many riders injure their back and knees. Often riders believe that they are using proper form when they are not. Since no one stands next to them throughout the exercise class, there is no way to address this issue, and even when instructors do attempt to remediate the riders' form, the riders cannot gauge if the corrective attempts are successful. The result is back, neck injuries, and reduced benefits of the workout. In other words, the cyclist works much harder for fewer results and potential injury.

The invention relates to stationary exercise equipment and specifically to a stationary training bicycle.

Benefits:

There are numerous benefits to be gained from this invention, including but not limited to:

Proper form

Eliminate injury to back, knees, and neck;

Increase core strength;

Maximize the desired exercise experience;

Maximize the cardio experience.

engage the user with immediate biofeedback

Uses:

In one aspect of the invention, a kit can easily be purchased by gyms, spinning studios like Soul Cycle™, Peloton™, and Flywheel™, and even home riders using remote group or private classes. As a result, it is not necessary to purchase a wholly newly designed stationary bicycle, which would be a costly proposition.

The instant application deals with proper user form when using a stationary training bicycle or stationary training machine, where a computer streams data reflecting the user force distribution. Prior art deals mostly with road simulation, display of cardio, and manual and automatic resistance adjustment.

Figure 9:
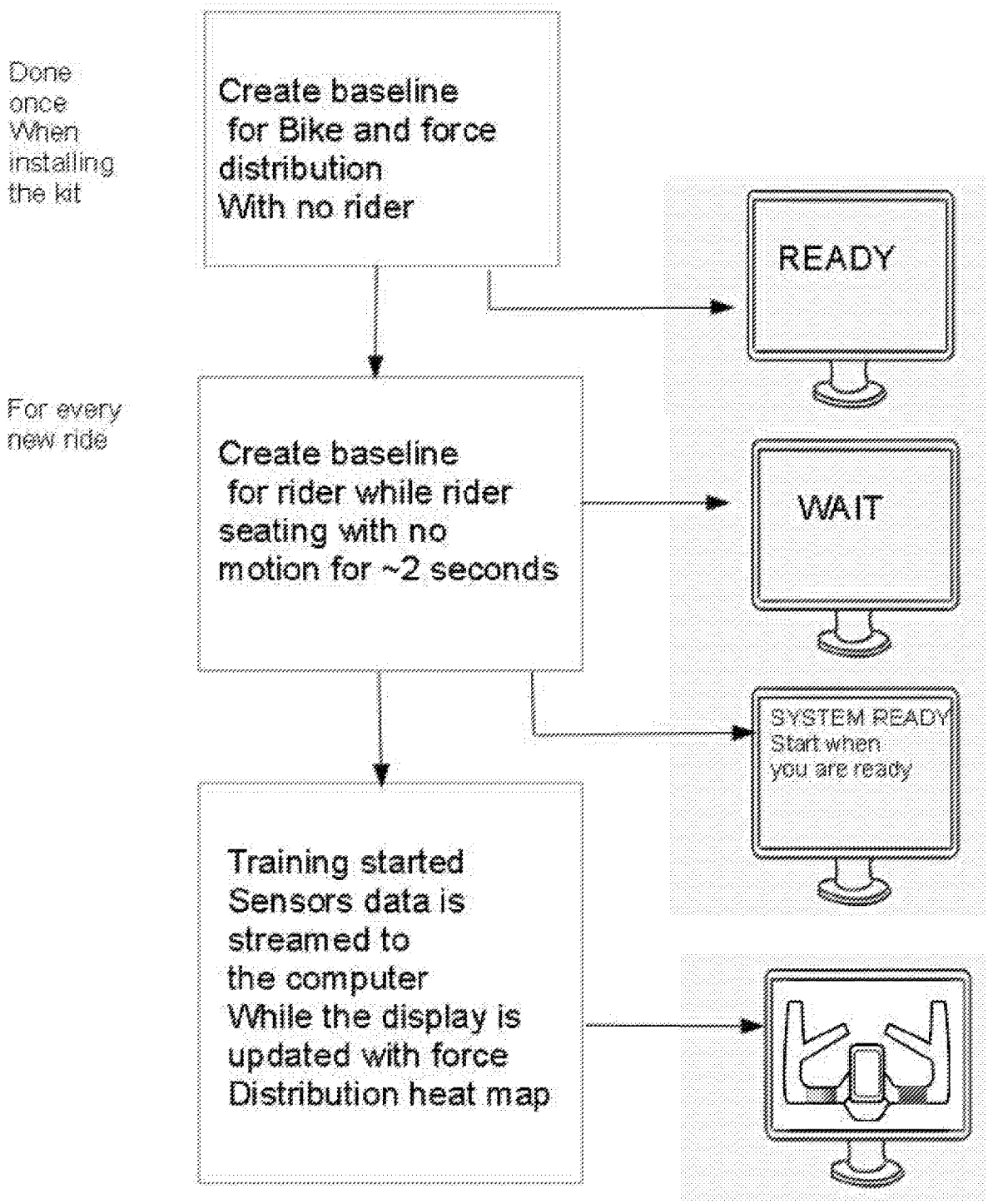

The instant application senses pressure and pressure changes and produces a heat map and/or stream data representing the pressure changes in one aspect of the invention. Where symmetry is changing, the user takes corrective action to make sure that the heat map is always in symmetry, as shown in FIG. 9.

The system is composed of sensors, a computer, and a display unit. The sensors read the pressure and/or weight and stream the data to the computer.

The instant application introduces at least four methods to implement the system. All methods are composed of pressure sensors and/or load cells, sending the information of the sensor to a computer where the computer analyzes the data and updates the display unit:

Method I—handlebars pressure is measured

Method II—Where pressure at the front joint (4) is measured

Method III—Change of force at the mat is measured (10)

Method IV—Change of force is measured only on points of contact (12)

DETAILED DESCRIPTION

Method I—where Handlebar Pressure is Measured

The present monitoring system may be implemented on any stationary bike 21. The stationary bike 21 may include a base with at least four points or areas of contact, i.e. two front points of contact 1 and two rear points of contact 2. The stationary bike 21 may include handlebars 3 supported by an upright post 22, which may include a middle joint 4 and a bottom joint 5. A display 6 may be provided for indicating such features as speed, time, calories burned, degree of difficulty, etc. A seat 23 may also be provided or provided separately by the user.

For the first method where the force measures from the hand pressure on the handlebars 3. Using a thin, lightweight rubber overlay 25 composed of flexible PCB with many pressure sensors 13-16 spaced at a small distance. The slim, lightweight overlay 25 fits perfectly over the handlebars 3. The sensors 13-15 inside the thin, lightweight overlay 25 may be spaced at about 0.1" (at least two sensors for the narrowest finger). The computer controller 30 keeps reading the data from the handle bars 3 and analyzes symmetry by comparing it to a baseline. Various manufacturers like 3M™, PPS™ and more, make such pads. This method is also utilized with a bike offering two sets of handles. Alternatively a mat can be composed of multiple pressure sensor transducers with the desired resolution where resolution is the distance between the sensors.

During a typical spinning exercise class, there are 4 hand positions used, and each of these 4 pressure points (or 8 for both the right and left side of the handlebars) correlates directly to those hand positions. Each pressure points A-D composed of a group of at least one pressure sensor 13-16. Each group is representing an area where the user is applying the force/pressure.

In First Position, the rider is usually seated, and the hands are placed close together over the back part of the handlebar 3 at the left and right-hand positions D on the diagram. There would be at least one sensor 13 at position D for measuring the force or pressure the rider is applying to that spot. There may also be a digital display 14, indicating a level, e.g. number, registered by the sensor 13 or displaying a heat map to reflect the same. The instructor could tell the entire class that the number that appeared on the digital display reader 14 must stay within a specific range or the color heat map should be within certain range. The heatmap will further indicate asymmetry or symmetry as the software keeps updating the symmetry/asymmetry points A-D.

In the second position, the rider is often standing upright off the seat 23 and has their hands placed on both the left and right positions of pressure point C proximate sensors 15. Very often, riders lean on the handlebars 3 in this position rather than using and developing their core strength by pulling their lower body as far back as possible. Again, the instructor could tell the whole class, rather than singling anyone rider out, to maintain the pressure at point C, i.e. sensors 15, at a number within a precise range to optimize the workout experience.

In the third position, the rider is often standing upright off the seat 23 and has their hands placed on both the left and right positions of pressure point A measured by one or more sensors 16, while leaning far over the handlebars 3.

Ideally, their lower body should be pulled very far back over the seat 23 while they are spinning their pedals to engage their core strength and not lean on their hands. Very often, riders lean on the handlebars 3 in this position rather than using and developing their core strength by pulling their lower body as far back as possible. Again, the instructor could tell the whole class, rather than singling any one rider out, to maintain the pressure at point A, i.e. sensors 16, at a number within a precise range to optimize the workout experience.

Finally, in exercises that employ the use of middle bar, the rider is often standing upright off the seat 23 and has their hands placed on both the left and right positions of pressure point B activating sensors 17.

Some of these exercises require leaning on the handlebars 3, while others do not. The beauty of this device is that the instructor is entirely in control of the class and can instruct riders on exactly when to apply pressure to the middle bar and when not to. The instructor could tell the whole class, rather than singling any one rider out, to maintain the pressure at point B, i.e. sensors 17, at a number within a precise range to optimize the workout experience.

The apparatus itself can be a thin rubber material similar to the existing handlebars 3 on stationary bicycles 21 to provide maximum comfort for the rider, with curved edges to easily slide over and snuggly fit onto the existing handlebars 3. There may be at least 8 weight/pressure measuring sensor 13,15-17 on the underside of each pressure point A through D, securely embedded in the overlay apparatus. The pressure point sensors 13, 15-17 would be exposed on the underside of the apparatus so that they can be easily replaced should they break or stop working. In another aspect of the invention, the sleeve 25 may be made of a matrix of sensors where multiple points (matrix) may be read and streamed to the computer controller 30. With multiple points the computer controller 30 may process the grip or even the grip of each finger on the handlebar 3 and provide a finer read of the users hand position.

Method II—when the Joint Front Handle is Measured

In this method, a flexible PCB or ring with at least eight sensors 25 (multi skin sensors) inserted around the pole 22, e.g. at joints 4 or 5. In this case, symmetry can easily be calculated by the computer 30 as the eight sensors 25 reflect the asymmetry represented by a plurality, e.g. N (North), S, E, W, NS, SE, EW, and W (west) equally spaced apart sensor locations. Alternatively, a representation by a circle of 360 degrees divided equally by the number of sensors 25 could represent with better resolution, especially if more than eight sensors 25 are used. Alternatively, a band 25 with multiple sensors 25 can be wrapped around at least one of the joints 4 and 5. Providing multiple numbers of sensing points. Implementing this method may require opening the joints 4 and/or 5 and inserting the sensors 25 in a ring structure or a band with multiple sensors. Alternatively, the joint hardware can be replaced with hardware 40 that accommodates the insertion of the weight band, and the rejointing of the tubes making up the upright post 22 by inserting each tube into joint cavity 26. The joint hardware 40 may have a cavity 26 on both sides. Each cavity 26 may accommodate for the insertion of the tubes and the sensors 25, e.g. mat, where the inner cavity 26 can be glued with the sensors mat 25 on each side. In another aspect of the invention the joint hardware 40 may have a sensor mat glued to the inside (the closer surface to the center tube) cavity. In another aspect of the invention a short tube with a band of multiple sensors 25 may be inserted and attached to the inner tube. Into the tube two or more ball bearing will be inserted where the inner ball bearing may allow for the joint 4 or 5 to be inserted. The use of ball bearings will allow the pressure to be distributed through the ball bearing outer surface and apply pressure on the load cell mat. In this instance also the ball bearing structure may be locked from rotating. Hence, the ball bearing is used to transfer the force in both radial and axial direction.

Method III—Change of Force is Measured on a Mat

This method utilizes gravity and the changes in gravity force distributed on a structure 100 composed of a basic support base 9, a sensor layer 10 and a top cover layer 8. The support base 9 may be comprised of hard materials, such as wood, plastic or steel, but is preferably comprised of stainless steel. The sensor layer 10 may be composed of a sensor mat 12 and a sensor support platform 11.

Method IV—Change of Force is Measured Only on Points of Contact

Figure 11:
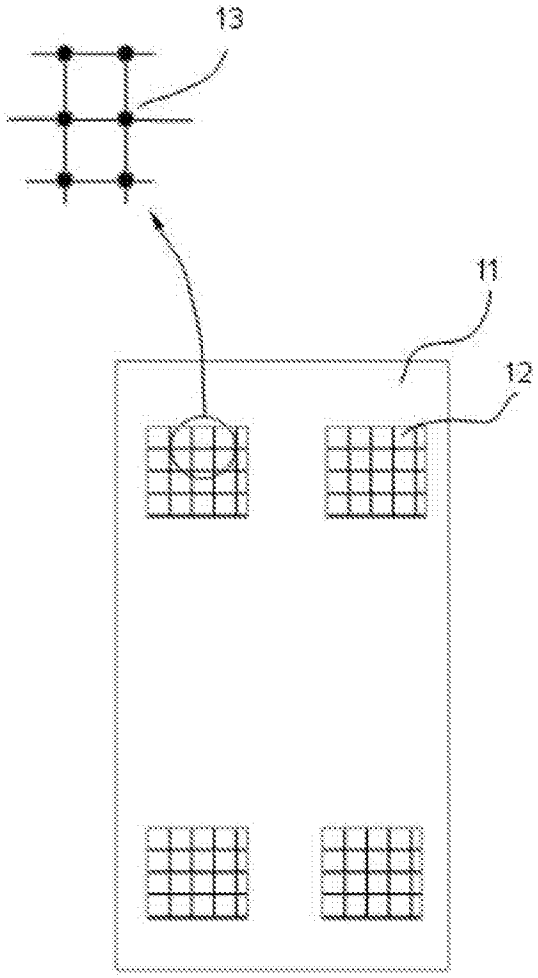
Figure 10:
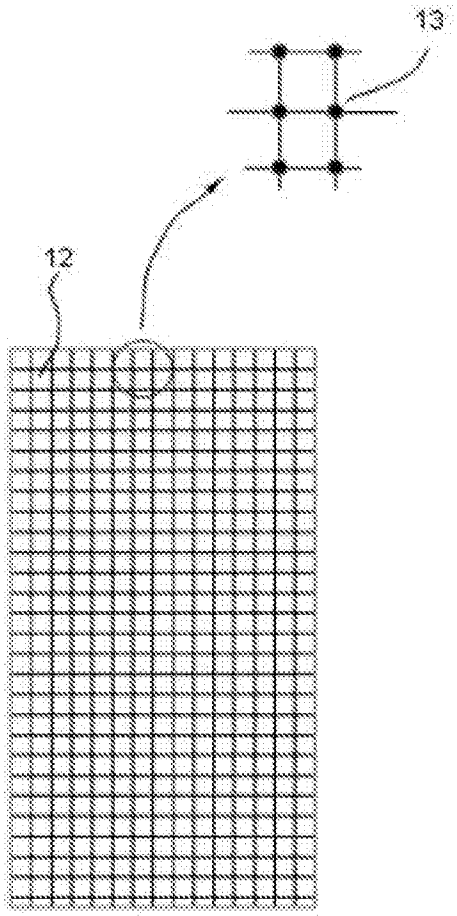
Figure 13:
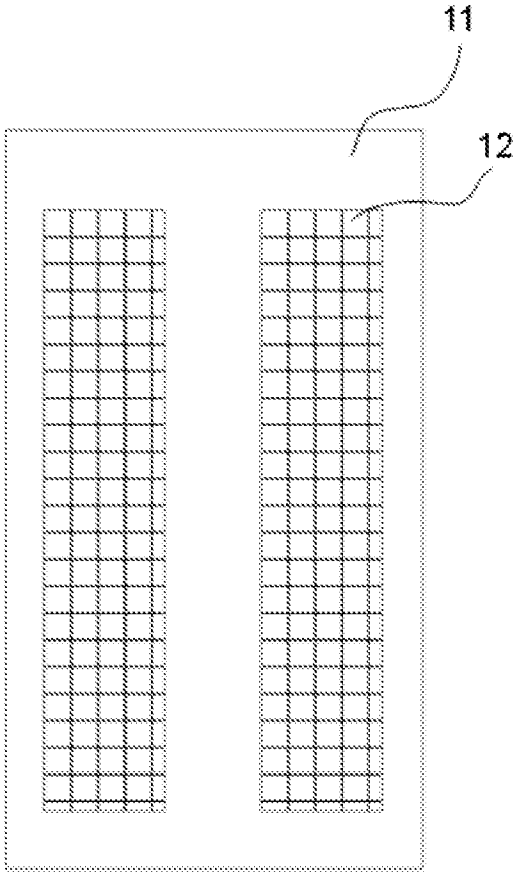
Figure 12:
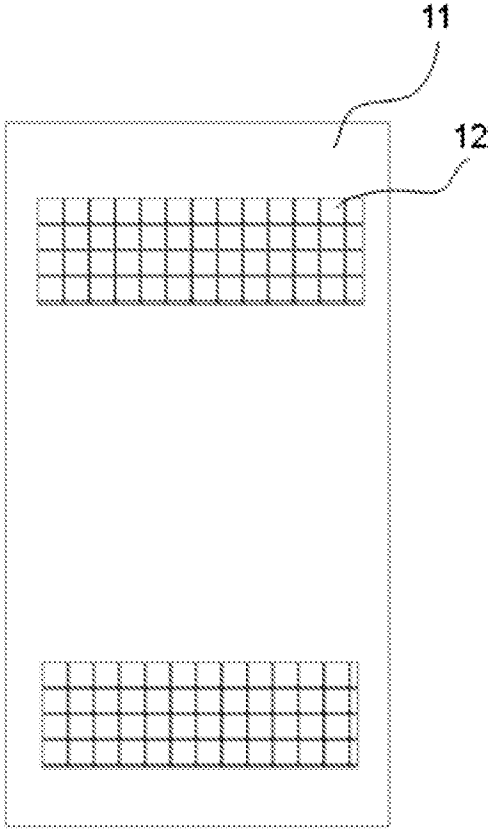
Figure 15:
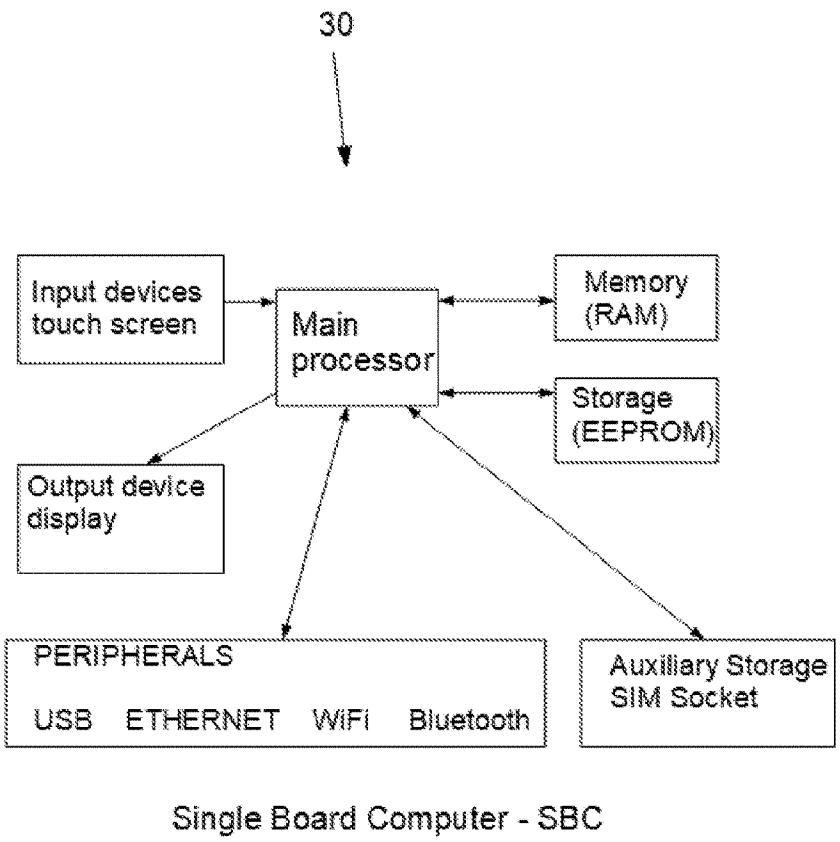
Figure 14:
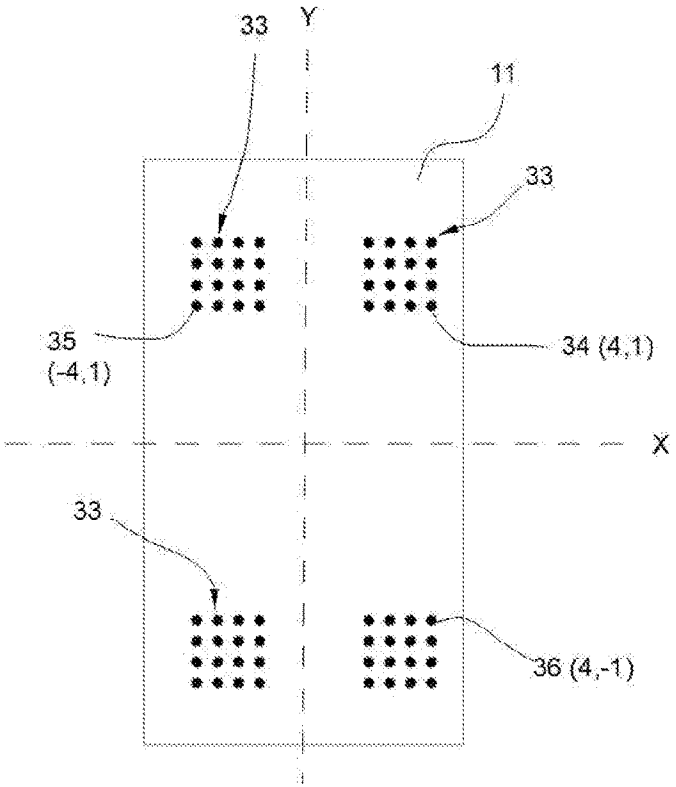
Figure 16:
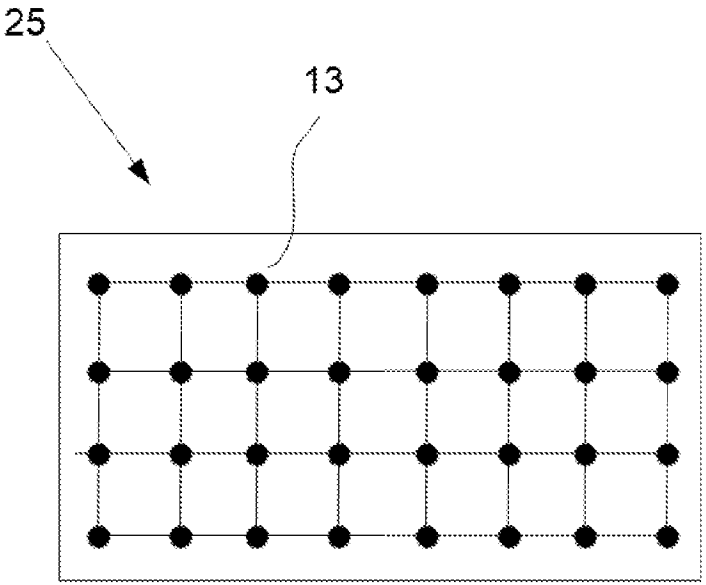
Figure 16:
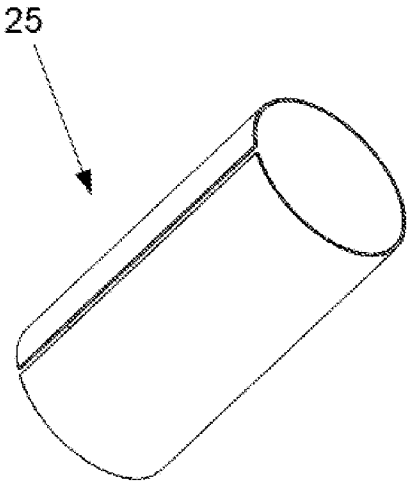
Figure 17:
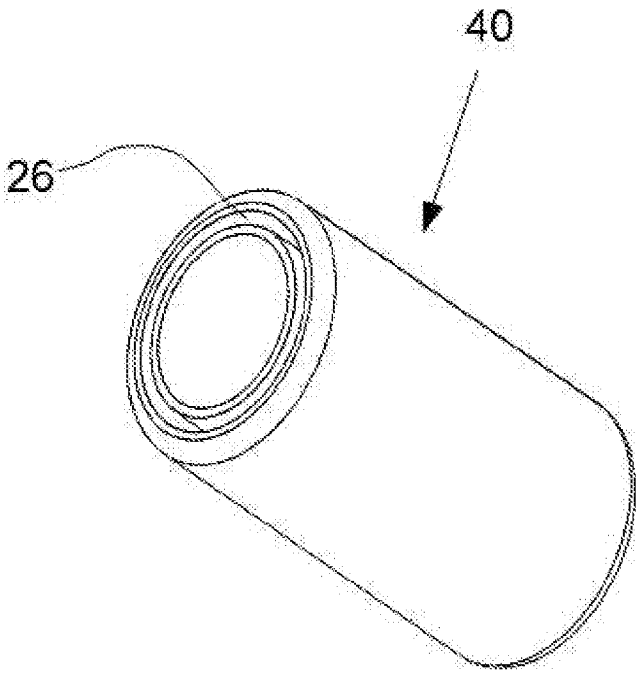

Similar to Method III but eliminating all sensors in the sensor mat 12 excluding the sensors in the front and rear contact areas 1 and 2, respectively. In the front and rear contact areas 1 and 2, a multi-sensor mini mat that covers only the individual contacts areas 1 and 2. On a flat surface, i.e. support base 9, preferably stainless steel metal surface four individual pressure sensor mats 12 are inserted under each of the front and rear contact points 1 and 2. In another aspect of the invention, a sensor mat 12 may include sensors only in four regions as shown in FIGS. 11, 12 and 13. One sensor mat 12 accommodates the various footprints of the training equipment. As an example, for equipment that varies in the long dimension, a sensor mat 12 with large vertical sensor patches can fit, as in FIG. 13. A sensor mat 12 with wide dimensions may include horizontal sensors patches that fits equipment that comes in variant width footprint size, as shown in FIG. 12.

Methods III & IV can provide more information, as the computer processor 30 calculates the user's weight distribution quickly. In fact, a shift of force could be noticeable in multiple sensors. If for instance the rider leans quickly on the handlebars 3 the back sensors on the mat 12 below rear contact points 2 will deliver smaller weight values while the front mat sensors below front contact points 1 will deliver higher weight distribution. In other words, as the total weight is constant, a shift of weight is detected by multiple sensors where some will detect additional force while other reduction is force.

Methods III & IV Deals with the big picture by analyzing gravity force and weight distribution. Therefore, removing extra noise that may appear in method I or method II, e.g., If the grip on the handle bar 3 is firm, then the computer in method I needs to further distinguish between a grip force and a form deviation force.

Operation

While the rider takes his/her seat 23, the computer processor 30 starts calculating weight distribution and creates a baseline for the rider. When the baseline is established, the system, i.e. the software stored on non-transitory memory and executable on the computer processor 30, signals the user that it is ready to start training. From this point, the sensors in the sensor mat 12 keep streaming information to the computer processor 30. The computer processor 30 processes the information and produces and displays an indication, e.g. a heat map, on the display 6 on location 14 representing the weight distribution, i.e. force applied by the user on the different groups of sensors below each point or area of contact, e.g. front and rear points of contact 1 and 2, or for Method I handlebars heatmap. As shown in FIG. 9.

Figure 2:
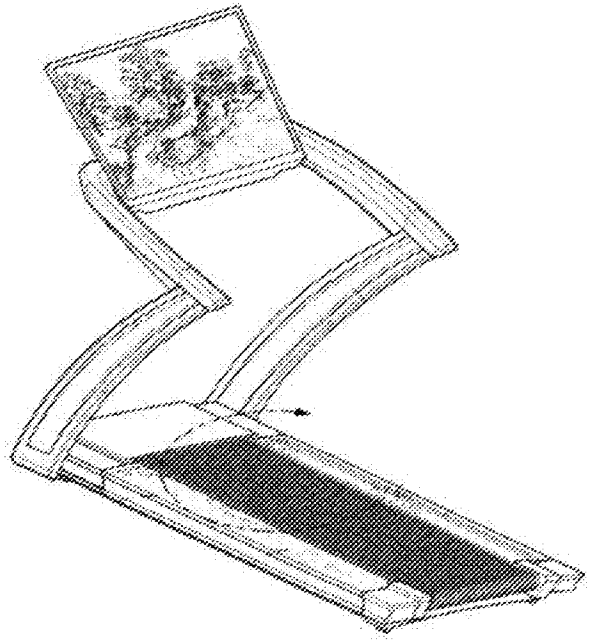
Fig 2 (Prior Art)
FIG. 2. Typical stationary treadmill exercise equipment with a display unit (Prior Art)
Figure 1:
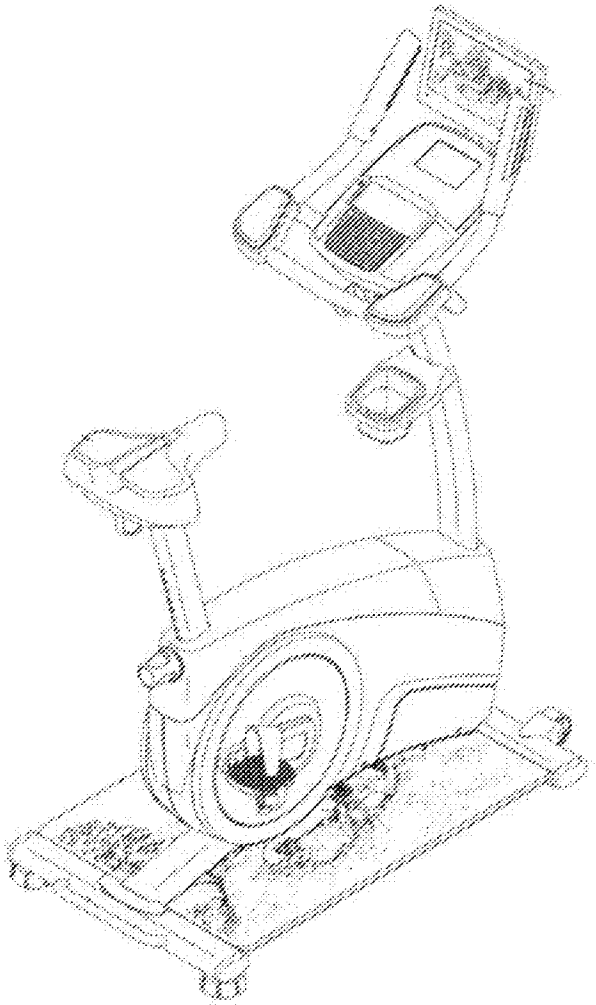
Fig 1 (Prior Art)
FIG. 1. Typical stationary bicycle exercise equipment with a display unit (Prior art)
Figure 4:
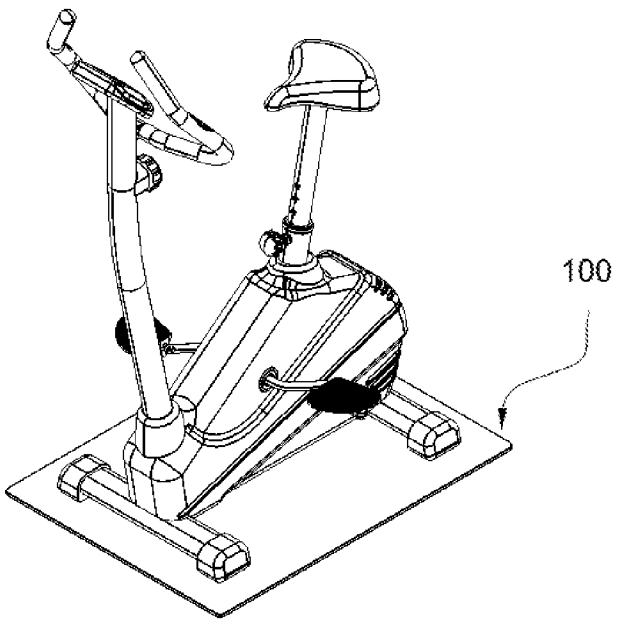
FIG. 4. A stationary bicycle with weight distribution mat
Figure 3:
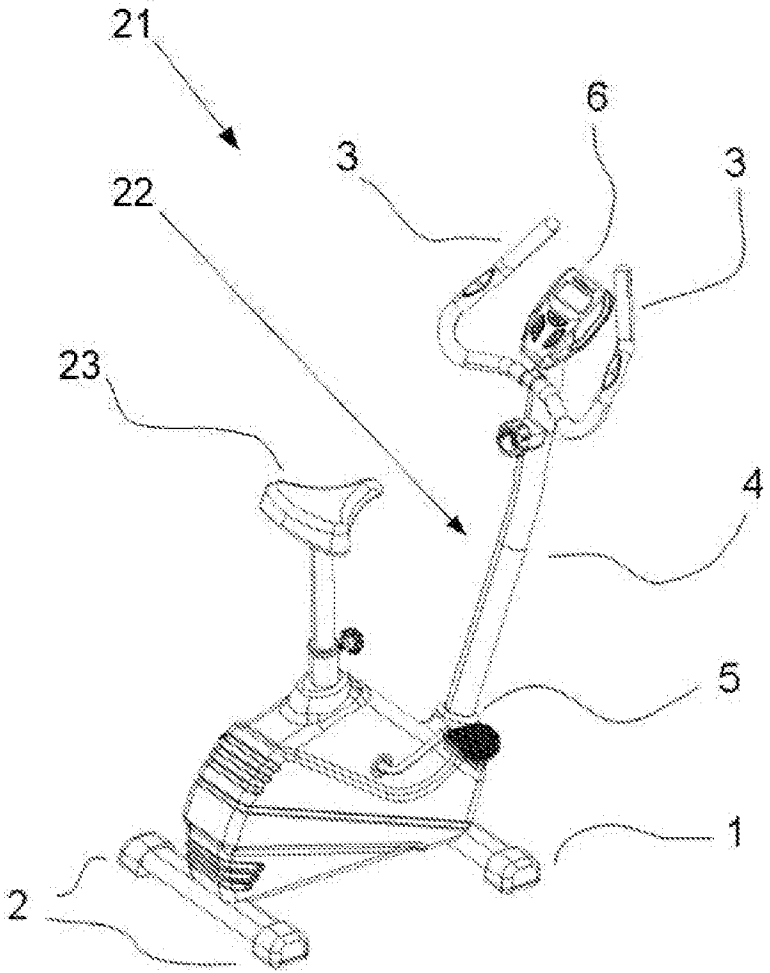
FIG. 3. A stationary bicycle with a console display
Figure 6:
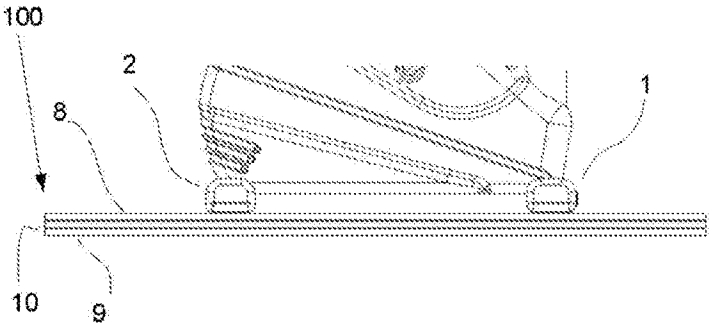
FIG. 6. Side view of a bicycle stationed on a weight distribution mat system FIG. 7. Side view of a Weight distribution mat system FIG. 8. Side view of the Weight distribution mat sensors layer FIG. 9. A flowchart describing the user interaction with the console FIG. 10. Top view of the Weight distribution mat sensors segment FIG. 11. Top view of the Weight distribution mat with four islands of sensors area FIG. 12. Top view of the Weight distribution mat with two horizontal islands of sensors segment FIG. 13. Top view of the Weight distribution mat with two vertical islands of sensors segment FIG. 14. Top view of the Weight distribution mat with four islands of sensors FIG. 15. A Single Board Computer FIG. 16. Sleeve with sensors FIG. 17. Joint tubes kit
Figure 8:
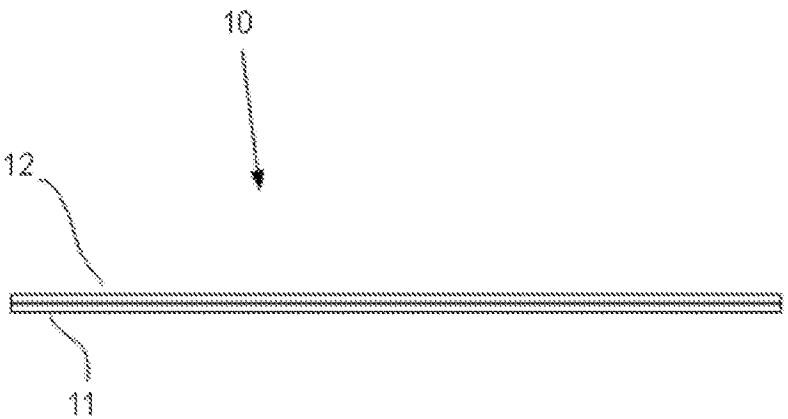
Figure 5:
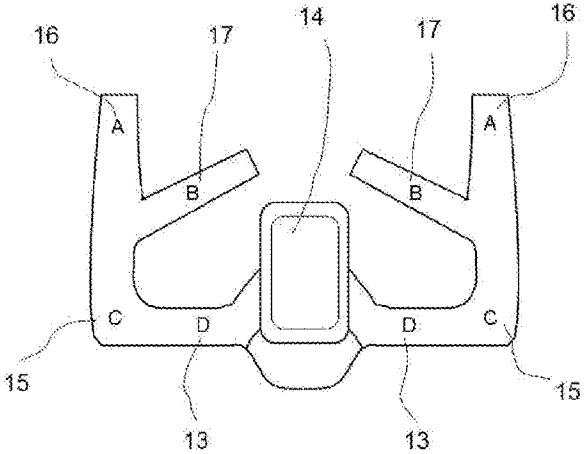
FIG. 5. A top view of a typical stationary handlebars with marked hand positions.
Figure 7:
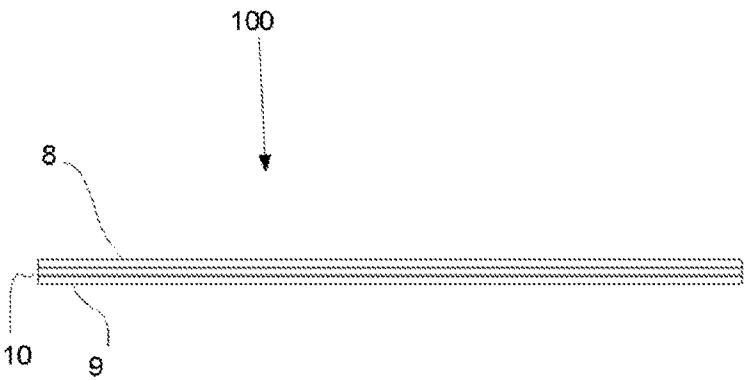

Implementation of Method I:

In this context, a sensor is reflecting a group of physical sensors covering an area as shown in FIG. 5. E.g. Sensor 16 will represent group of physical sensors covering area A.

A slim, lightweight rubber overlay designed to fit perfectly over the handlebars 3 as a slide on attachment, bearing at least 8 pressure point sensors 13, 15-17 designed to measure the amount of pressure the rider is placing on them, would entirely and simply resolve this issue, operating much like a scale to weigh food or other items. During a typical spinning exercise class, there are 4 hand positions used and each of these 4 pressure points (or 8 for both the right and left side of the handlebars 3 correlates directly to those hand positions.

In First Position, the rider is usually seated, and the hands are placed close together over the back part of the handlebar 3 at the left and right-hand positions D (sensors 13) on the diagram. There would be a sensor 13 here measuring the weight or pressure the rider is applying to that spot D. There would also be a digital display reader 14, indicating the number registered by the sensor 13. The instructor could tell the entire class that the number that appeared on the digital display reader 14 must stay within a specific range or a specific color range if it is on a heatmap display.

In the second position, the rider is often standing upright off the seat 23 and has their hands placed on both the left and right positions of pressure point C (sensors 15). Very often, riders lean on the handlebars 3 in this position rather than using and developing their core strength by pulling their lower body as far back as possible. Again, the instructor could tell the whole class, rather than singling one rider out, to maintain the pressure at point C (on sensors 15) at a number or heatmap color within a precise range to optimize the workout experience.

In the third position, the rider is often standing upright, not touching the seat 23. Their hands placed on both the left and right positions of pressure point A (over sensors 16) and leaning far over the handlebars 3.

Ideally, their lower body pulls very far back over the seat 23 while they are spinning their pedals to engage their core strength and not lean on their hands. Very often, riders lean on the handlebars 23 in this position rather than using and developing their core strength by pulling their lower body as far back as possible. Again, the instructor could tell the whole class, rather than singling one rider out, to maintain the pressure at point A at a number within a precise range to optimize the workout experience.

Finally, in exercises that employ the use of the middle bar, the rider is often standing upright off the seat 23 and has their hands placed on both the left and right positions of pressure point B (over sensors 17).

Some of these exercises require leaning on the handlebars 3, while others do not. The beauty of this device is that the instructor is entirely in control of the class and can instruct riders on exactly when to apply pressure to the middle bar and when not to. The instructor could tell the whole class, rather than singling one rider out, to maintain the pressure at point B (via sensors 17) at a number within a precise range to optimize the workout experience.

Gyms quickly purchase this slide-on attachment, spinning studios like Soul Cycle™, Peloton™ and Flywheel™, and even home riders using remote group or private classes. As a result, it is not necessary to purchase a wholly newly designed stationary bicycle, which would be a costly proposition.

The apparatus itself can be a thin rubber material similar to the existing handlebars on stationary bicycles to provide maximum comfort for the rider, with curved edges to easily slide over and snuggle fit onto the existing handlebars. There is a weight/pressure measuring sensor 13, 15-16 on the underside of each pressure point A (16) through D (13), securely embedded in the overlay apparatus.

Implementation of Method III & IV:

The front and rear points of contacts 1 and 2 with the sensor mat 12 where the bottom of the bicycle 21, at points 1 and 2 will apply pressure on the mat system 100. The mat system 100 will deliver the pressure/force to the array of sensors below. As the user sits the weight will distribute across all sensors points 33. Each sensor point 33 will read a sensing value reflecting the weight it reads on that spot. The computer controller 30 will process all of the sensor points 33 and compare their values to the previous values. Any changes of values will be grouped and analysed based on their location in relation to the symmetry lines X and Y, e.g. left and right and/or front and back of bicycle 21. In totality, the total weight of the rider and the stationary bike 21 should add up to the total reading of all measurements by the sensors 33.

Please note: the sensors 33 that are not in contact with the equipment will not show changes besides some noise that can easily filtered by requiring more than two reads to validate a change. Each sensor 33 may be marked with a coordinate, e.g. using an (x,y) notation with the axis along the lateral central and longitudinal central axis of the exercise equipment and the rider. As an example, the sensor in location (4,1) will represent a specific sensor 34. While specific sensor 35 represents sensor in location (−4, 1). In this case sensor 34 and sensor 35 are symmetrical to the Y axis. When positioning the equipment on the mat 12 there is no need to lineup the geometry to seek symmetry. The software and the computer controller 30 will locate symmetry points by running a few times to calibrate the equipment over the mat 12. Second phase calibration will take place when the riders sits on the equipment. There will be no complete symmetry as the equipment may not be symmetrical. So the software will locate all points of contacts based on the reads coming from the sensors 33 affected by the change of weight. This way the software and the computer controller 30 will mark all the unused sensors 33. We refer to symmetry as symmetry sensor locations. Using this method the sensing of a change will be amplified as it is read via at least two sources. As an example, let's say the user is leaning to the right. This lean will be sensed with increase of sensor reading for all sensors 33 to the right of the longitudinal central axis Y, while at the same time will see a decrease in reading with all sensors 33 on the left of longitudinal central axis Y. This simultaneous reading will create a shift in the total amount of weight of the sensors 33 located to the right of the longitudinal central Y axis. The software and the computer controller 30 may now update the heat map on the right to the Y axis with intense color while lightening up the color on the display on the left of the Y axis. Additionally, the read value reflects the proportional weight, therefore the multiple reading can be sorted prioritizing the sensors 33 that were mostly affected.

Similar analysis can be made between the front part of the equipment to the back part of the equipment taking points at, e.g. front right (34) and back right (36), that are symmetric to lateral central X. Analysing the points on the top side of the X axis and the points at the bottom side of the X axis.

In totality, the software and the computer controller 30 may compose all symmetric points to the Y axis and all symmetrical points to the X axis as one result that can be mapped with two main colors associated with the location, as well.

In another aspect of the invention, additional symmetry points may be tested that are not geometry symmetrical, but do relate to changes. As an example sensor 36 in the back right may relate to sensor 35 in the front left, e.g. diagonally opposite zone. Although, the marking may indicate symmetry they may not be symmetrical. However, they will sense changes that reflects movements that have a diagonal component to it.

In another aspect of the invention symmetry can be defined as any two sensors 33 that have the same change of value, e.g. while one will have positive change while the other negative change. This definition will be assigned while calibrating the exercise device and/or when the user is instructed to simulate a ride by either sitting or standing. The heat map will provide a visual reflection of the pairs of sensor groupings where colors will be intensified when a force, e.g. weight, is increased, and weakened when the weight value decreases.

In another aspect of the invention symmetry groups of sensors 33 may be defined based on the type of movement. There maybe a sitting group of sensors, and there maybe a standing group of sensors. This way the software and the computer controller 30 may easily analyse not only changes to a sensor 33 but also detect what the user is doing. As an example if the sitting group of sensors 33 shows changes that are significantly larger than any other group of sensors 33 then the user is sitting.

A sensor 33 can belong to multiple groups.

In another aspect of the invention the software will keep track of the changes to monitor the rate of change.

Benefits:

There are numerous benefits to be gained from this invention/exercise device, including but not limited to:

Proper form;
Eliminate injury to back, knees, and neck;
Increase core strength;
Maximize the desired exercise experience;
Maximize the cardio experience.

The invention claimed is:

1. A monitoring system for an exercise device comprising:
a base mat including a plurality of sensors;
an exercise equipment comprising a stationary training equipment selected from the group consisting of a rowing machine, a stationary bicycle and a treadmill mounted on the base mat;
a computer controller configured for receiving measurements from the plurality of sensors and providing an indication on a display of locations of force application of a user on the exercise device.

2. The system according to claim 1, wherein the base mat includes a front right contact area, a front left contact area, a back right contact area and a back left contact area; and
wherein the plurality of sensors comprises a set of sensors distributed at various locations on a support platform beneath the base mat.

3. The system according to claim 2, wherein the set of sensors comprises a first grouping of sensors configured for positioning beneath the front right contact area and the front left contact area; and a second grouping of sensors configured for positioning beneath the back right contact area and the back left contact area; and
wherein the computer controller provides an indication of locations and change of locations of force application of a user about a lateral central axis of the exercise device.

4. The system according to claim 2, wherein the set of sensors comprises a first grouping of sensors configured for positioning beneath the front right contact area and the back right contact area; and a second grouping of sensors configured for positioning beneath the front left contact area and the back left contact area; and
wherein the computer controller provides an indication of locations and change of locations of force application of a user about a longitudinal central axis of the exercise device.

5. The system according to claim 2, wherein the set of sensors comprises a first grouping of sensors configured for positioning beneath the front right contact area;
a second grouping of sensors configured for positioning beneath the front left contact area; a third grouping of sensors configured for positioning beneath the back right contact area; and a fourth grouping sensors configured for positioning beneath the back left contact area;
wherein the computer controller provides an indication of locations and change of locations of force application of a user about a longitudinal central axis and lateral central axis of the exercise device.

6. The system according to claim 5, wherein the computer controller provides an indication to the user on the display of the intensity of force application on the first grouping of sensors, the second grouping of sensors, the third grouping of sensors, and the fourth grouping of sensors to illustrate the user's weight distribution on the exercise device.

7. A monitoring system for an exercise device comprising:
an exercise equipment comprising a stationary training equipment selected from the group consisting of a rowing machine, a stationary bicycle and a treadmill;
a base mat made of a plurality of sensors split into groups where each group covers an area sufficient to be in contact with a point of contact of the exercise equipment;
a computer controller configured for receiving measurements from the plurality of sensors and providing an indication on a display of locations of force application of a user on the exercise device; and
wherein the base mat is placed between a floor and the exercise equipment.

8. The system according to claim 7, wherein the base mat includes a front right contact area, a front left contact area, a back right contact area and a back left contact area; and
wherein the plurality of sensors comprises a set of sensors distributed at various locations on a support platform beneath the base mat.

9. The system according to claim 8, wherein the set of sensors comprises a first grouping of sensors configured for positioning beneath the front right contact area and the front left contact area; and a second grouping of sensors configured for positioning beneath the back right contact area and the back left contact area; and
wherein the computer controller provides an indication of locations and change of locations of force application of a user about a lateral central axis of the exercise device.

10. The system according to claim 8, wherein the set of sensors comprises a first grouping of sensors configured for positioning beneath the front right contact area and the back right contact area; and a second grouping of sensors configured for positioning beneath the front left contact area and the back left contact area; and
wherein the computer controller provides an indication of locations and change of locations of force application of a user about a longitudinal central axis of the exercise device.

11. The system according to claim 8, wherein the set of sensors comprises a first grouping of sensors configured for positioning beneath the front right contact area;
a second grouping of sensors configured for positioning beneath the front left contact area; a third grouping of sensors configured for positioning beneath the back right contact area; and a fourth grouping sensors configured for positioning beneath the back left contact area;
wherein the computer controller provides an indication of locations and change of locations of force application of a user about a longitudinal central axis and lateral central axis of the exercise device.

12. The system according to claim 11, wherein the computer controller provides an indication to the user on the display of the intensity of force application on the first grouping of sensors, the second grouping of sensors, the third grouping of sensors, and the fourth grouping of sensors to illustrate the user's weight distribution on the exercise device.

13. A monitoring system for an exercise device comprising:
an exercise equipment comprising a stationary training equipment selected from the group consisting of a rowing machine, a stationary bicycle and a treadmill;
a base mat made a of plurality of sensors split into two groups where each group covers an area sufficient to be in contact with one or more points of contact of the exercise equipment;
a computer controller configured for receiving measurements from the plurality of sensors and providing an indication on a display of locations of force application of a user on the exercise device; and wherein the base mat is placed between a floor and the exercise equipment.

14. The system according to claim 13, wherein the base mat includes a front right contact area, a front left contact area, a back right contact area and a back left contact area; and wherein the plurality of sensors comprises a set of sensors distributed at various locations on a support platform beneath the base mat.

15. The system according to claim 14, wherein the set of sensors comprises a first grouping of sensors configured for positioning beneath the front right contact area and the front left contact area; and a second grouping of sensors configured for positioning beneath the back right contact area and the back left contact area; and wherein the computer controller provides an indication of locations and change of locations of force application of a user about a lateral central axis of the exercise device.

16. The system according to claim 14, wherein the set of sensors comprises a first grouping of sensors configured for positioning beneath the front right contact area and the back right contact area; and a second grouping of sensors configured for positioning beneath the front left contact area and the back left contact area; and wherein the computer controller provides an indication of locations and change of locations of force application of a user about a longitudinal central axis of the exercise device.

17. The system according to claim 14, wherein the set of sensors comprises a first grouping of sensors configured for positioning beneath the front right contact area;

a second grouping of sensors configured for positioning beneath the front left contact area; a third grouping of sensors configured for positioning beneath the back right contact area; and a fourth grouping sensors configured for positioning beneath the back left contact area;

wherein the computer controller provides an indication of locations and change of locations of force application of a user about a longitudinal central axis and lateral central axis of the exercise device.

18. The system according to claim 17, wherein the computer controller provides an indication to the user on the display of the intensity of force application on the first grouping of sensors, the second grouping of sensors, the third grouping of sensors, and the fourth grouping of sensors to illustrate the user's weight distribution on the exercise device.

* * * * *